United States Patent [19]

Maurer et al.

[11] 4,360,982

[45] Nov. 30, 1982

[54] BUCKET WITH REMOVABLE CUTTING PLATE

[75] Inventors: Herman J. Maurer, Burlington; John F. Shumaker, Mt. Pleasant, both of Iowa

[73] Assignee: J. I. Case Company, Racine, Wis.

[21] Appl. No.: 239,634

[22] Filed: Mar. 2, 1981

[51] Int. Cl.[3] ..... E02F 9/28

[52] U.S. Cl. ..... 37/141 R

[58] Field of Search ..... 37/141 R, 141 T, 142 R, 37/118, 117.5, 103, DIG. 3

[56] References Cited

U.S. PATENT DOCUMENTS

| | | | |
|---|---|---|---|
| 7,340 | 5/1850 | Davis | 37/141 R |
| 1,885,741 | 11/1932 | Lutes | 37/142 R |
| 2,981,015 | 4/1961 | Duke | 37/141 T |
| 3,014,293 | 12/1961 | Boatman et al. | 37/141 R |
| 3,059,357 | 10/1962 | Irish | 37/141 R |
| 3,469,331 | 9/1969 | Wood | 37/141 R |
| 3,523,380 | 8/1970 | Bolyard et al. | 37/141 R |
| 3,550,293 | 12/1970 | Helton | 37/141 T |
| 3,648,391 | 3/1972 | Kabay et al. | 37/141 T |
| 3,984,929 | 10/1976 | Meyer et al. | 37/141 R |
| 4,271,614 | 6/1981 | Albrecht | 37/141 TX |

FOREIGN PATENT DOCUMENTS

| | | | |
|---|---|---|---|
| 514976 | 7/1955 | Canada | 37/141 R |
| 92888 | 9/1958 | Norway | 37/141 R |
| 720308 | 12/1954 | United Kingdom | 37/141 R |

*Primary Examiner*—E. H. Eickholt

*Attorney, Agent, or Firm*—Dressler, Goldsmith, Shore, Sutker & Milnamow, Ltd.

[57] ABSTRACT

An improved, highly utilitarian bucket is described. The bucket incorporates two traversely spaced side walls connected by a backwall plate so as to form a generally scoop-shaped enclosure. The leading edge of the backwall is provided with a one-piece cutting-edge plate disposed between the side walls and formed with a plurality of tangs along its leading edge. The tangs are adapted to removably carry a plurality of generally flat tooth-plates. Each tooth-plate defines two oppositely disposed beveled edges. Because of the symmetric nature of the tooth-plates, they may be reversed to extend, if not double their useful life. Several embodiments of the tooth-plates are described. In addition, the bucket is particularly adaptable to serve as a mount for a easily connected back-fill blade.

11 Claims, 14 Drawing Figures

FIG.1
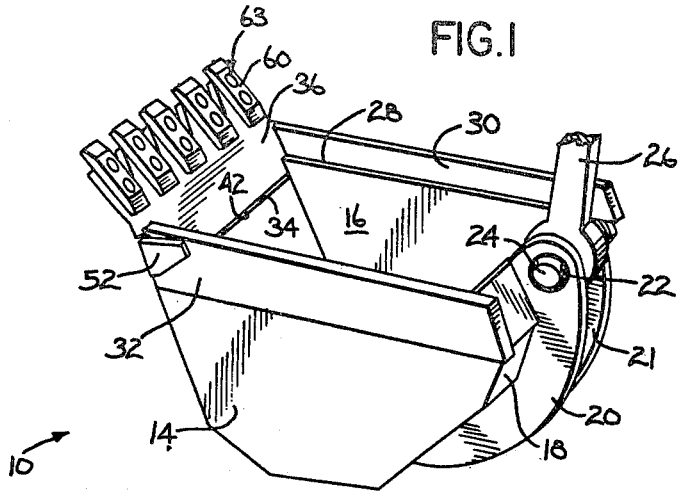
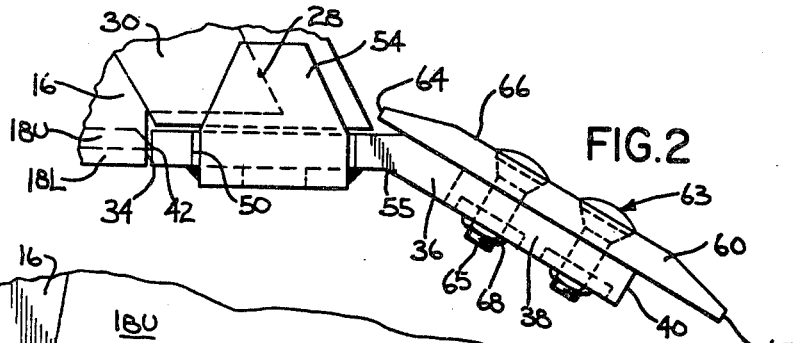
FIG.2
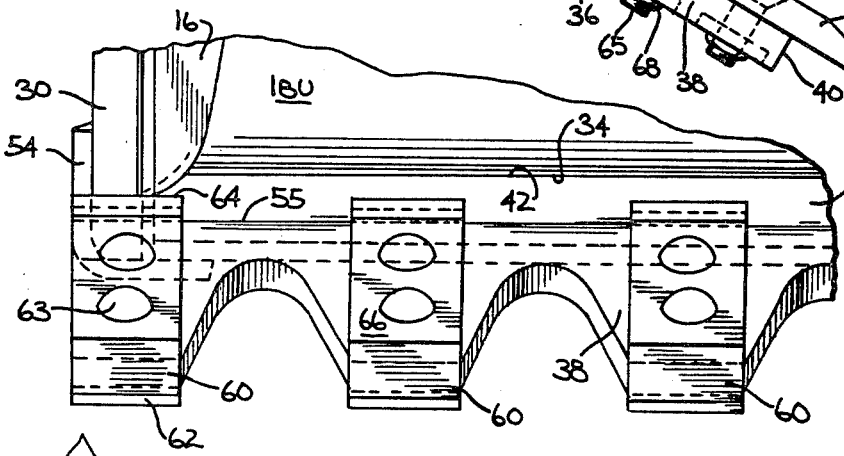
FIG.3
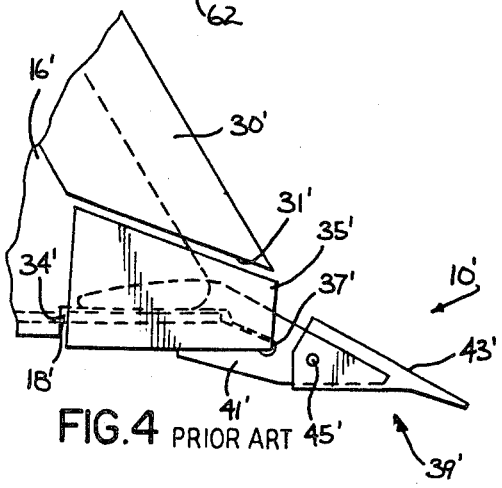
FIG.4 PRIOR ART
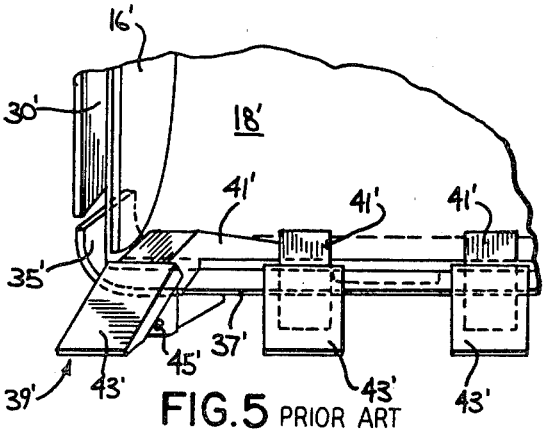
FIG.5 PRIOR ART

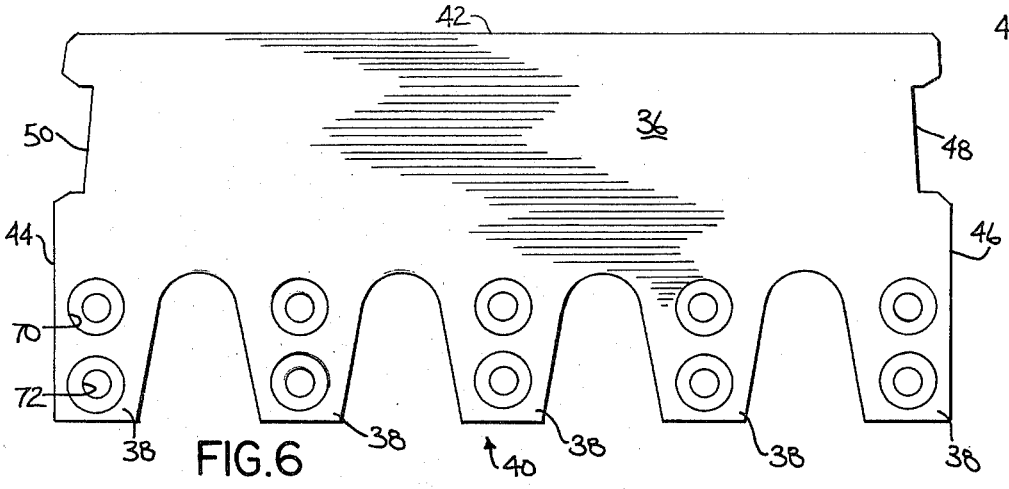
FIG.6
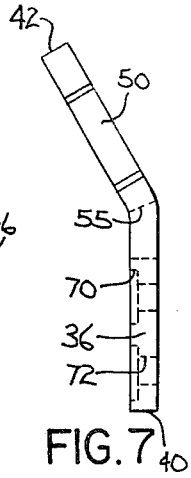
FIG.7
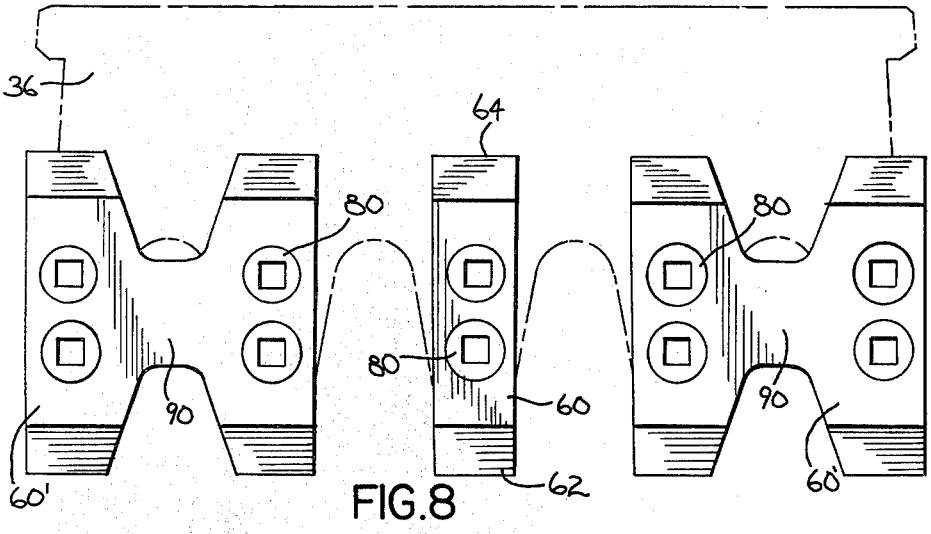
FIG.8
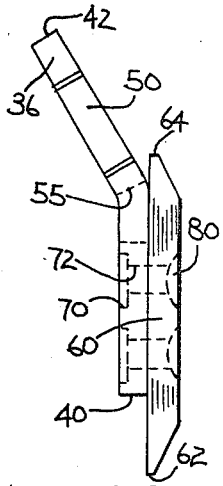
FIG.9
FIG.10
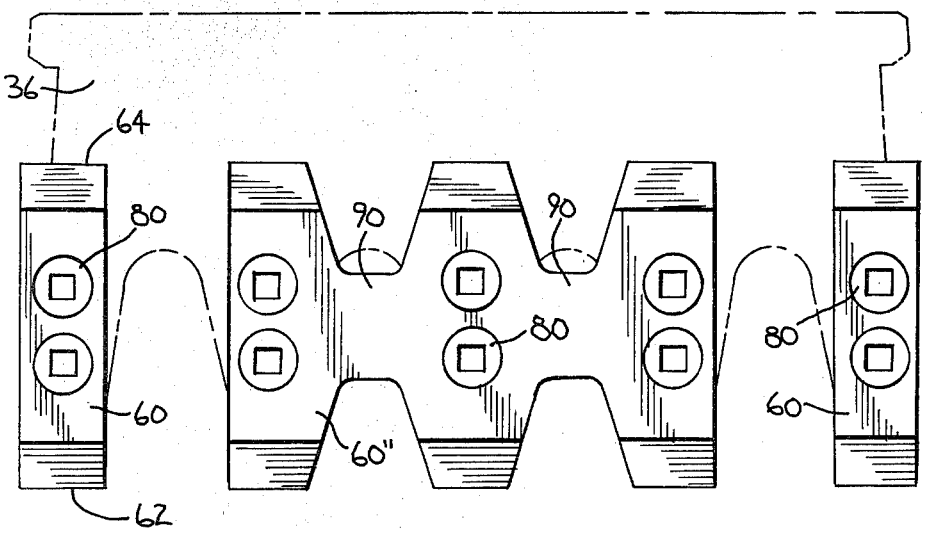
FIG.11
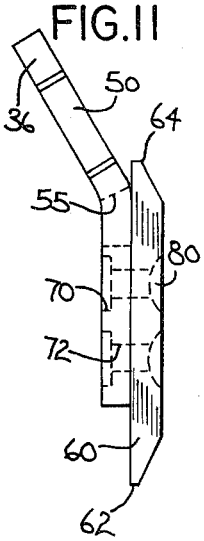

BUCKET WITH REMOVABLE CUTTING PLATE

TECHNICAL FIELD

This invention is related to earthworking and material handling implements and more particularly to buckets and scoops of the type having a plurality of teeth used to facilitate the bucket or scoop in engaging an enbankment or a pile of material.

BACKGROUND OF THE INVENTION

For the most part those buckets and scoops used in material handling applications consists of a pair of sidewalls, a bottom wall which interconnects the sidewalls and provides a forwardly disposed lip or digging edge, and a plurality of teeth fixedly or removably mounted along the forward edge of the backwall lip. The bucket itself is connected to a pivotal arm such as a dipperstick of a backhoe or lift arms of a loader. When the bucket is placed in operation the dipperstick or arm is crowded into an embankment or pile of material so as to force the teeth to penetrate the material. The teeth as such form a wedge to facilitate the bucket engaging and breaking out of the material. As can be appreciated the teeth are exposed to substantial bending stresses and, relative to the main body of the bucket, are rapidly worn away through use.

Heretofore it has been common practice to provide teeth which are especially hardened or configured to resist wear and to mount the teeth in such a manner that the stresses imposed on them are distributed to the maximum extent to the backwalls and the sidewalls of the bucket. Those skilled in the art know that these practices have not been entirely satisfactory. These buckets are often difficult to service in the field. The cost of manufacturing these teeth and the cost of maintaining the bucket in a good working condition have been relatively high. What is needed is a relatively inexpensive bucket design incorporating a set of teeth which are inexpensive to manufacture, easy to install, and easy to maintain, particularly in the field or at the job site. A bucket design incorporating all of these features especially one which would increase the useful life of the teeth and one which could serve as a mount for other accessories would be readily accepted by the industry.

SUMMARY OF THE INVENTION

In accordance with the present invention a bucket is provided that is formed from two transversely spaced sidewalls or sidewall plates, a backwall plate which joins together the sidewall plates to form a scoop-shaped opening, a cutting edge plate which is disposed between the sidewalls and along the leading edge of the backwall plate, and at least one generally flat tooth-plate which has two oppositely disposed beveled edges and which is carried by the cutting edge plate. Preferably, the tooth-plate or plates are removably connected to the cutting edge plate. The cutting edge plate is provided with a series of tangs with the tooth-plates disposed atop the tangs. The cutting edge plate is bent outwardly relative to the leading edge of the backwall plate to facilitate the engagement between the tooth-plates and material to be removed by the bucket. Gusset plates can be used to strengthen the bond between the cutting edge plate and the sidewalls of the bucket. With the exception of the tooth-plate, all of the components of the bucket are permanently joined together by a process such as welding.

Several embodiments of the tooth-plates are described. Each tooth-plate is formed from a generally flat metal plate which has been machined to form at least two oppositely disposed beveled edges. That beveled edge disposed outwardly defines the working edge of the tooth-plate. As such, the tooth-plate, in its simplest form, is generally rectangular in shape. To facilitate installation of the tooth-plates or to facilitate fabrication of the tooth-plates, one or more tooth-plates can be permanently joined together so as to define a generally H-shaped plate or a plate in the form of a Roman Numeral three (i.e. III). When the working edge of a bucket tooth-plate becomes sufficiently worn, the tooth-plate can be reversed so as to expose the opposite beveled edge. This doubles the service life of the bucket teeth relative to a bucket having ordinary non-reversible teeth. Because the bucket teeth are removable and flat a back-fill blade can be easily attached to a cutting edge plate by using the same bolts or fasteners used to connect the tooth-plates to the cutting edge plate. This improves the versatility of the bucket and adds to the utility in the field. Numerous other advantages and features of the present invention will become readily apparent from the following detailed description of the invention and the embodiments thereof, from the claims and from the accompanying drawings.

BRIEF DESCRIPTION OF THE DRAWINGS

FIG. 1 is a perspective view of the bucket that is the subject of the present invention;

FIG. 2 is a enlarged, side elevational view of the leading edge of the bucket illustrated in FIG. 1;

FIG. 3 is a partial, enlarged front elevational view of the leading edge of the bucket shown in FIG. 2;

FIG. 4 is a fragmentary, side elevational view of the leading edge of a bucket of conventional design;

FIG. 5 is a partial, front elevational view of the bucket section illustrated in FIG. 4;

FIG. 6 is a plan view of the lower surface of the cutting-edge plate used to form the bucket shown in FIG. 1;

FIG. 7 is a side elevational view of the cutting-edge plate shown in FIG. 6 after being bent to have a generally V-shaped cross section;

FIG. 8 illustrates two embodiments of the tooth-plates adapted to be used with the bucket cutting-edge plate shown in FIG. 6;

FIG. 9 is a side elevational view of the tooth-plates shown in FIG. 8 in relationship to the cutting-edge plate shown in FIG. 7;

FIG. 10 is an illustration of another embodiment of a tooth-plate adapted to be used with the cutting-edge plate shown in FIG. 6;

FIG. 11 a side elevational view of the tooth-plates shown in FIG. 10 in relationship to the cutting-edge plate shown in FIG. 7;

DESCRIPTION OF THE PREFERRED EMBODIMENTS

Figure 12:
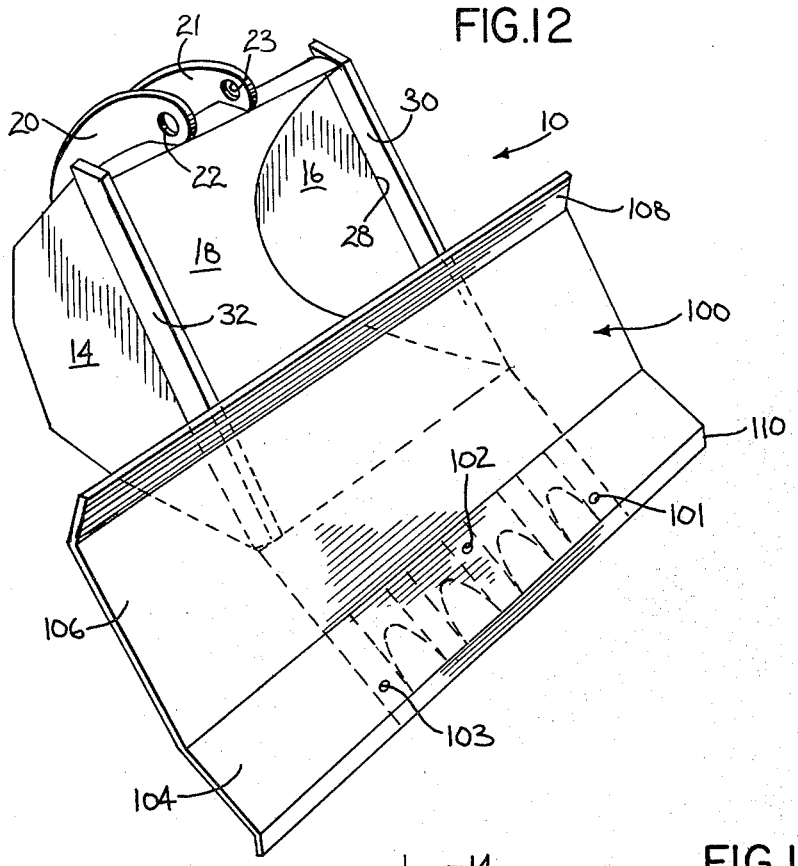
FIG. 12 is a perspective view of the bucket illustrated in FIG. 1 carrying a back-fill blade disposed along the leading edge of the bucket.
Figure 14:
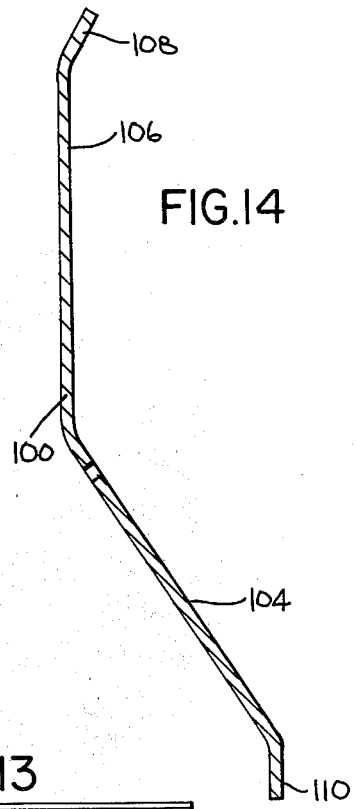
FIG. 14 is a cross-sectional, side elevational view of the back-fill blade shown in FIG. 13 as viewed along line 14—14 of FIG. 13.

While this invention is susceptible of embodiment in many different forms, there is shown in the drawings and will herein be described in detail several specific embodiments with the understanding that the present invention is to be considered as an exemplification of the principles of the invention and is not intended to limit the invention to those specific embodiments illustrated.

Turning to the drawings, FIG. 1 is a perspective view of a bucket 10 incorporating the principles of the invention. The main body of the bucket is formed from two vertically disposed, spaced-apart side wall plates 14 and 16 which are connected together by a backwall plate 18 so as to form a generally scoop-shaped enclosure. The backwall plate 18 and the two sidewall plates 14 and 16 are preferably securely joined together by a process such as welding. The backwall of the bucket can be formed from two separate plates sandwiched together (a so-called double wrapper design). FIG. 2 illustrates a bucket 10 formed from two backwall plates 18U and 18L. One of these plates 18U defines the inside of the bucket 10 while the other plate 18L defines the outside surface of the bucket.

The bucket 10 is adapted to be connected to an implement, such as the dipperstick of a backhoe or the lift arms of a loader, by suitable mounting brackets. In FIG. 1 two lugs 20 and 21 are attached to the outside surface of the backwall plate 18. Each of the lugs is provided with an aperture 22, 23 (See FIG. 12) so as to form a clevis-like mounting arrangement. For purposes of generality, a connecting link 26 is shown disposed between the two lugs and pivotally connected to the lugs by a pivot shaft 24.

Reinforcing plates are used to strengthen the main body of the bucket 10. In FIG. 1 the exposed upper edge 28 (only one being shown) of each sidewall plate 16, 14 is protected by a generally elongated straight-edged reinforcing plate 30, 32. Similarly, the leading edge 34 of the backwall plate 18 is reinforced with a one-piece cutting-edge plate 36.

FIG. 6 is a plan view of the cutting-edge plate 36. The cutting-edge plate is preferably formed from one flat metal plate and then bent so as to form a generally V-shaped cross-section (See FIG. 7). The cutting-edge plate 36 then defines two generally flat rectangular elements joined together or meeting together along a bending line 55. The cutting-edge plate has a thickness generally equal to the thickness of the backwall 18.

Heretofore, it was common practice to form a bucket 10' (See FIGS. 4 and 5) with a leading edge formed from a generally U-shaped lip plate 35'. This U-shaped lip plate 35' was disposed at the leading edge 34' of the backwall plate 18' such that it overlapped the exterior surface of the two side walls 35' (only one being shown). As such, it wrapped around the backwall plate 18' and connected together the two leading edges 31' (only one being shown) of the reinforcing plates 30' (only one being shown) on each side wall 16' (only one being shown). Teeth or tooth elements 39' were disposed along the leading edge 37' of the U-shaped lip plate 35'.

Typically, each tooth element 39' in an ordinary bucket 10' was a composite structure. In FIGS. 4 and 5, the tooth elements are shown formed from a generally V-shaped mounting bracket 41' which had an interior portion which was complementary to the leading edge 37' of a U-shaped lip plate 35'. A generally flat blade 43' was disposed along the leading edge of the mounting bracket 41'. In some cases, each blade 43' was connected to the mounting bracket 41' by a removable fastener 45'. U.S. Pat. No. 3,896,569 to Thompson et al. describes a typical construction. It goes without saying that this is a relatively complicated and expensive arrangement for connecting the blades 43' (which form the working edges and working surfaces of the tooth elements 39') to the main body of the bucket 10'. Moreover, alignment problems were frequently experienced in properly mounting the tooth elements 39 on the bucket 10'.

In FIG. 6 the cutting-edge plate 36 is formed with a plurality of tangs 38 so as to define a serrated edge 40 at the forward or leading edge of cutting-edge plate. The opposite elongated edge 42 of the cutting-edge plate 36 is generally straight and even so as to match with the leading edge 34 of the backwall 18. The two shorter edges 44 and 46 are provided with a pair of oppositely disposed, generally rectangular recesses 48 and 50. The distance between the two shorter edges 44 and 46 of the cutting-edge plate 36 is generally equal to the distance between the outer surfaces of the two sidewall reinforcing plates 30 and 32. These recesses 48 and 50 provide a space or opening for receiving a pair of generally L-shaped gusset plates 52 (see FIG. 1) and 54 (see FIG. 2). These gusset plates 52 and 54 strengthen the connection between the cutting-edge plate 36 and the two side walls 14 and 16.

A plurality of tooth-plates 60 are disposed at the leading edge of 40 of the cutting-edge plate 36 along the inside of the bucket 10. In one embodiment, the tooth-plates were fabricated from MS-356 15B35H (Boron) that was hardened and tempered to 415-515MB using a water quench. Alternatively, MS-353 C1080 may be used. In that case if the tooth body is flame cut, it should be stress relieved at 1100° F. to 1200° F. for at least 30 minutes following the cutting operation. In its simplest form each tooth-plate is a generally rectangular flat metal plate (See FIG. 8). The two opposite short edges 62 and 64 of the tooth-plate 60 are beveled so as to form edges that are generally wedge-shaped (See FIGS. 2 and 9). The tooth-plates 60 are removably connected to the cutting-edge plate 36 by conventional fasteners 63, such as ordinary nuts and bolts (see FIG. 2).

To facilitate securing the tooth-plate 60 to the cutting-edge plate 36, each tooth-plate is provided with a pair of apertures 80 complementary to a corresponding pair of apertures 72 on the cutting edge plate. For convenience, these apertures 80 can be formed so as to receive a bolt 65 of the carriage bolt variety. In that particular case, the aperture would have a square cross-section surrounded by an enlarged circular cross-section. The head of the bolt 65 should not excessively project above the upper surface 66 of the tooth-plate 60. This insures that the headed portion of the bolt 65 does not interfere with the wedging action of the tooth-plate 60 and the serrated edge 40 of the cutting-edge plate 36. FIG. 5 shows the exterior surface of the cutting-edge plate 36. A circular recess 70, concentric with an aperture or bore 72 in the cutting-edge plate, is provided in a countersunk relationship. This allows a lock washer to be housed within the body of the cutting-edge plate 36.

It should, of course, be appreciated that the tooth-plates 60 can be formed in other convenient shape. A generally I-shaped or rectangular shaped tooth-plate embodies the principal teachings of the invention. In FIG. 8 two such I-shaped plates are joined together by a web element or section 90 so as to form a generally H-shaped tooth-plate 60'. Similarly, in FIG. 10 three I-shaped tooth-plates are joined together by two web sections 90 so as to form a tooth-plate 60'' in the shape of a Roman Numeral three (i.e. III). Other shapes and configurations follow from this manner of connecting together the basic I-shaped tooth-plate 60.

It has been observed by some operators of shovels and buckets that those teeth along the corners of the bucket generally experience a greater rate of wear or deterioration than those teeth disposed along or at the center of the bucket. For this reason, the particular shape and mounting arrangement of teeth shown in FIG. 10 may find added utility. If the corner teeth deteriorate more rapidly, those teeth when in the form of the basic I-shape, can be rapidly changed by simply removing one or more bolts. The teeth between the two ends of the bucket may be more conveniently joined together in either a H-shaped or III-shaped configuration depending on the width of the bucket.

Figure 13:
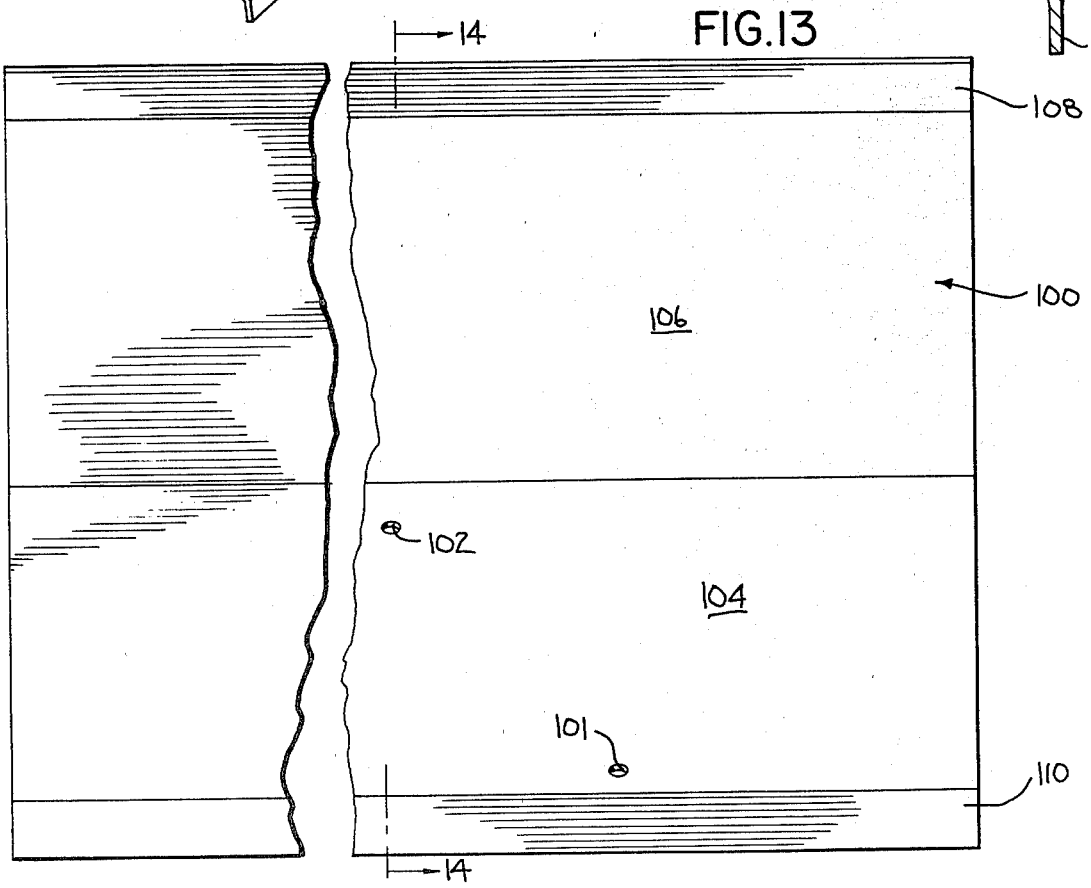
FIG. 13 is a foreshortened plan view of the back-fill blade shown in FIG. 12.

Because the tooth-plates 60, 60', 60'' are disposed flatly atop the cutting-edge plate 36 (See FIG'S. 2, 9, and 10), the bucket 10 that is the subject of the present invention is particularly adapted to be used with a one piece back-fill blade 100 disposed atop the open end of the bucket and along the top of the tooth-plates. As illustrated in FIG. 12, the back-fill blade 100 can be easily connected to the bucket by the installation of three threaded fasteners 101, 102, and 103. These fasteners can be installed in the same apertures already formed within the tooth-plates 60 and the cutting-edge plate 36. As shown in FIG. 13 the cross-section of the back-fill blade is generally V-shaped with one wing or section 104 disposed atop the tooth-plates and a second wing or section 106 disposed atop the side walls 14 and 16. That end of the back-fill blade disposed atop the bucket side walls is bent upwardly to form a spill wall 108. The spill wall guides material moved or displaced by the back-fill blade 100 towards the front of the blade and away from the interior of the bucket 10. A similar bend 110 at the edge of the wing 104 which rests against the tooth-plates 60 is also provided. This bent portion 110 is directed downwardly so as to cover the leading edges 40 and 62 of the cutting-edge plate 36 and the tooth-plates 60. This facilitates making a smooth, flat, even pass.

Thus from the foregoing description and the appended drawings, it should be evident that the present invention provides an improved bucket that is particularly easy to fabricate and maintain. Because of the simplified design, it is also easily adaptable to be used as a base or mount for other accessories such as a back-fill blade. Although the invention has been described in conjunction with several specific embodiments, it should be understood that various modifications in this structure may be made without departing from the spirit and essential characteristics of the invention. All such modifications and variations are to be included within the scope of the appended claims.

What is claimed is:

1. A bucket comprising:

(a) two transversely spaced sidewall plates;

(b) a backwall plate joining together said sidewall plates to define a scoop-shaped opening, one edge of said backwall plate being recessed relative to the leading edges of said sidewall plates;

(c) a generally flat bucket tooth-plate having two oppositely disposed beveled edges; and (d) a cutting edge base plate carried between said sidewall plates and ahead of said one edge of said backwall, and at least two tangs defined by the leading edge of said base plate, said tooth-plate being disposed and supported on and along said tangs and adjacent the interior of said scoop-shaped opening with one of the beveled edges of said tooth-plate lying ahead of the leading edge of said tangs, and removeable means for removably mounting said tooth-plate at the interior of said scoop-shaped opening.

2. A bucket, comprising:

(a) two transversely spaced sidewall plates each plate defining a leading edge;

(b) a wraparound backwall plate connecting said sidewall plates being disposed between said sidewalls to define a leading edge which is offset towards the interior of said scoop-shaped opening at a spaced distance from the leading edges of said sidewall plates;

(c) a V-shaped bent leading edge plate having a first portion which is disposed along the leading edge of said backwall plate and between said sidewall plates, and a second bent portion which defines a plurality of outwardly disposed mounting and support tangs, said tangs projecting beyond the leading edges of said sidewalls and outwardly of and away from the interior of said scoop-shaped opening;

(d) a one-piece, reversible tooth-plate disposed along at least one of said tangs and adjacent the interior of said scoop-shaped opening, said tooth-plate defining two oppositely disposed edges; and (e) removable means for removably connecting said reversible tooth-plate to said one tang with one of the edges of said tooth-plate lying in advance of the leading edge of said one tang, whereby said one edge of said bucket tooth-plate is worn away through use in preference to said one tang and said tooth-plate has a service life generally twice as long as a tooth-plate having one beveled edge.

3. The bucket set forth in claim 2, wherein said tooth-plate is generally flat and is symmetric about two mutually perpendicular planes of symmetry, whereby said tooth-plate can be disposed on said one tang in any one of four orientations.

4. A bucket, comprising:

(a) two transversely spaced sidewall plates;

(b) a backwall plate joining together said sidewall plates to define a scoop-shaped opening, one edge of said backwall plate being recessed relative to the leading edges of said sidewall plates;

(c) a generally flat bucket tooth-plate having two oppositely disposed beveled edges; and (d) cutting-edge plate means, carried between said sidewall plates and ahead of said one edge of said backwall, for removably mounting said tooth-plate at the interior of said scoop-shaped opening with one of the beveled edges of said tooth-plate disposed ahead of the leading edges of said sidewall plates, said cutting-edge plate means defining a bent portion which is disposed outwardly and away from the interior of said scoop-shaped opening.

5. The bucket set forth in claim 4, wherein said tooth-plate has a generally rectangular plan outline configuration.

6. A bucket, comprising:

(a) two transversely spaced sidewall plates;

(b) a backwall plate joining together said sidewall plates to define a scoop-shaped opening, one edge of said backwall plate being recessed relative to the leading edges of said sidewall plates;

(c) a generally flat bucket tooth-plate having two oppositely disposed beveled edges; and (d) cutting-edge plate means, carried between said sidewall plates and ahead of said one edge of said backwall, for removably mounting said tooth-plate at the interior of said scoop-shaped opening with one of the beveled edges of said tooth-plate disposed ahead of the leading edges of said sidewall plates, said cutting-edge plate means including a base plate formed from a single flat plate whose thickness is generally the same as the thickness of said backwall plate, said base plate defining a mating edge which abuts said one edge of said backwall and an oppositely disposed leading edge which is disposed outwardly relative to the interior of said scoop-shaped opening and beyond the leading edges of said sidewalls, and the leading edge of said base plate defining at least two tangs, said tooth-plate being disposed along at least one of said tangs and adjacent the interior of said scoop-shaped opening with one of the beveled edges of said tooth-plate lying ahead of the leading edge of said tangs.

7. A bucket, comprising:

(a) two transversely spaced sidewall plates;

(b) a backwall plate joining together said sidewall plates to define a scoop-shaped opening, one edge of said backwall plate being recessed relative to the leading edges of said sidewall plates;

(c) a generally flat bucket tooth-plate having two oppositely disposed beveled edges; and (d) cutting-edge plate means, carried between said sidewall plates and ahead of said one edge of said backwall, for removably mounting said tooth-plate at the interior of said scoop-shaped opening with one of the beveled edges of said tooth-plate disposed ahead of the leading edges of said sidewall plates, said cutting-edge plate means including a base plate formed from a single flat plate whose thickness is generally the same as the thickness of said backwall plate, said base plate defining a mating edge which abuts said one edge of said backwall and an oppositely disposed leading edge which is disposed outwardly relative to the interior of said scoop-shaped opening and beyond the leading edges of said sidewalls, and wherein said base plate is joined to at least one of said sidewall plates and defines an edge having a recess disposed along said one sidewall plate; and further including gusset plate means, having a cross section generally complementary to said recess, for joining the exterior surface of said base plate to the exterior surface of said one sidewall plate, whereby the connection between said cutting edge plate means and said one sidewall plate is reinforced.

8. A bucket, comprising:

(a) two transversely spaced sidewall plates;

(b) a backwall plate joining together said sidewall plates to define a scoop-shaped opening, one edge of said backwall plate being recessed relative to the leading edges of said sidewall plates;

(c) a generally flat bucket tooth-plate having two oppositely disposed beveled edges, said tooth-plate having a generally H-shaped plan outline configuration defining two pairs of oppositely disposed beveled edges; and (d) cutting-edge plate means, carried between said sidewall plates and ahead of said one edge of said backwall, for removably mounting said tooth-plate at the interior of said scoop-shaped opening with one of the pairs of beveled edges of said tooth-plate disposed ahead of the leading edges of said sidewall plates.

9. A bucket, comprising:

(a) two transversely spaced sidewall plates;

(b) a backwall plate joining together said sidewall plates to define a scoop-shaped opening, one edge of said backwall plate being recessed relative to the leading edges of said sidewall plates;

(c) a generally flat bucket tooth-plate having two oppositely disposed beveled edges, said tooth-plate defining a generally Roman numeral III-shaped plan outline configuration defining three pairs of oppositely disposed beveled edges; and (d) cutting-edge plate means, carried between said sidewall plates and ahead of said one edge of said backwall, for removably mounting said tooth-plate at the interior of said scoop-shaped opening with one of the beveled edges of said tooth-plate disposed ahead of the leading edges of said sidewall plates.

10. A bucket, comprising:

(a) two transversely spaced sidewall plates;

(b) a backwall plate joining together said sidewall plates to define a scoop-shaped opening, one edge of said backwall plate being recessed relative to the leading edges of said sidewall plates;

(c) a generally flat bucket tooth-plate having two oppositely disposed beveled edges; and (d) cutting-edge plate means, carried between said sidewall plates and ahead of said one edge of said backwall, for removably mounting said tooth-plate at the interior of said scoop-shaped opening with one of the beveled edges of said tooth-plate disposed ahead of the leading edges of said sidewall plates, said cutting-edge plate means including removable means for removably attaching said tooth-plate, and further including a back-fill blade disposed atop said tooth-plate and along the leading edges of said sidewall plates, said back-fill blade being connected to said cutting-edge plate means by said removable means.

11. The bucket set forth in claim 10, wherein said back-fill blade is formed from a single flat plate bent to conform to the leading edges of said sidewalls and said cutting-edge plate means such that one portion of said back-fill plate is disposed along the leading edges of said sidewall plates and another portion of said back-fill plate is disposed atop said tooth-plate.

* * * * *